United States Patent [19]

Babuka et al.

[11] Patent Number: 4,863,395

[45] Date of Patent: Sep. 5, 1989

[54] ZERO INSERTION FORCE CONNECTOR WITH COMPONENT CARD

[76] Inventors: Robert Babuka, 128 Hawthorne St., Vestal, N.Y. 13850; Vincent M. Fiacco, 713 Zeggert Rd., Endicott, N.Y. 13760; John L. Piechota, 1105 Ford Rd., Vestal, N.Y. 13850

[21] Appl. No.: 297,370

[22] Filed: Jan. 17, 1989

[51] Int. Cl.[4] ..... H01R 9/09

[52] U.S. Cl. ..... 439/260; 439/377

[58] Field of Search ..... 439/259–268, 439/377, 64

[56] References Cited

U.S. PATENT DOCUMENTS

| | | | |
|---|---|---|---|
| 4,540,228 | 9/1985 | Steele | 339/74 R |
| 4,542,950 | 9/1985 | Gillett et al. | 339/75 MP |
| 4,636,019 | 1/1987 | Gillett et al. | 339/17 M |

OTHER PUBLICATIONS

IBM Tech. Discl. Bulletin, "Zero Insertion Force Card Seating and Locking Mechanism", vol. 31, No. 2, Jul. 1988.

IBM Tech. Discl. Bulletin, "Low-Cost Zero-Insertion-Force Connector System", vol. 31, No. 4, Sep. 1988.

IBM Tech. Disclosures Bulletin, "Cam-Actuated Zero Insertion Force Connector", vol. 30, No. 5, Oct. 1987.

*Primary Examiner*—Gary F. Paumen

*Attorney, Agent, or Firm*—Malin, Haley & McHale

[57] ABSTRACT

A zero insertion force connector system with a top entry for improved interconnection with a component card and a component card positioner for providing an interconnectable structure that is useable with adjacent apparatus. The zero insertion force connector system includes a housing with a card guide channel having a top entry and a sliding cam system for interlocking the component card positioner and the component card in an improved manner. The component card positioner includes a card positioning structure with a tab cover structure and a card guide channel positioner for interaction with the sliding cam system of the zero insertion force connector system to properly interconnect the component card. The component card includes card contact tabs protected by a tab cover structure in the component card positioner and related to connector contacts positioned in the housing of the connector. The sliding cam system includes card retention lobes that mate with the lobe positioners in the card guide channel positioner for positioning the component card in an improved physical manner.

6 Claims, 2 Drawing Sheets

ZERO INSERTION FORCE CONNECTOR WITH COMPONENT CARD

FIELD OF THE INVENTION

The present invention relates to a zero insertion force connector system for interconnecting a component card and component card positioner to provide an interconnected mechanism usable in data processing equipment.

BACKGROUND OF THE INVENTION

Component cards or printed circuit board assemblies for mounting and interconnecting electronic components are well-known. Various types of connectors for making physical and electrical interconnection with component cards or printed circuit board assemblies are also well-known. Component cards or printed circuit board assemblies are often interconnected through associated connectors in panel-type assemblies. Connector arrangements account for the insertion and removal of component cards or printed circuit board assemblies.

The low insertion force provides the name Zero Insertion Force (ZIF) connectors. Advantages of ease of insertion and removal of the printed circuit board assembly, minimization of contact wear, and maximization of the number of connector contact for this type of connector have been recognized and described in the prior art.

One example of a low insertion force connector used for making electrical connection between printed circuit board assemblies and external circuitry is disclosed in U.S. Pat. No. 4,540,228 to Steele. It describes an improved linear cam actuating mechanism in the low insertion force connector.

Another example of a zero insertion force (ZIF) connector for electrically connecting I/O pads of a printed circuit board and a set of printed conductors is disclosed in U.S. Pat. No. 4,542,950 to Gillett et al. This patent describes cams actuated to engage contacting of parts.

The disclosure in U.S. Pat. No. 4,636,019 to Gillett et al discloses a connector mechanism for connecting portions of the structures. The disclosed connector mechanism is an effective ZIF connector.

One zero insertion force card seating and locking mechanism disclosed in IBM Technical Disclosure Bulletin Vol. 31, No. 2, pp. 138, 139, dated July 1988, discloses a spring-biased sensor pin which senses the position of an insertable printed circuit (PC) card in a ZIF connector and, if the card is improperly positioned, it prevents the actuation of the ZIF connector. A blunt-nosed spring-biased sensor pin is contained in an opening in the ZIF connector housing body and retained in the openings by a concentric apertured plug housing. A spring biases the sensor pin so that the sensor pin protrudes into the card channel or slot in the connector housing body with just enough force to maintain the sensor pin in position. The connector actuator cam is shown in its open or deactuated position with a through hole or opening in line with or registered with the sensor pin. This opening is configured to have clearance around the sensor pin, permitting free movement of sensor pin against the force provided by the spring. The chamfered or wedge-like part of the entering edge of a PC card or board may be in contact with the card, but not exerting force, on the sensor pin. Once the card enters the ZIF connector's body, the sensor pin is now displaced and protrudes into the hole or opening in the connector actuator cam in its open or deactuated position opening, thereby obstructing the actuating cam. As a result, ZIF actuation is prevented until the card is either withdrawn or is completely inserted in channel or slot. When the card is in its home position, the spring forces the sensor pin to the right where it is in interference with the chamfered or wedge-like part of the exiting edge of the PC card. The sensor pin is now clear of the opening in the actuating cam, so the cam can be operated as shown to move closing contacts of the ZIF connector against the contacts on the PC card. With the cam in such a position, it prevents movement of the sensor pin and, thus, the card is held in place in the mechanism.

It should be particularly noted that the edges of the card which come in contact with the sensor pin are chamfered to enhance the action of the card moving the plunger of the sensor pin. The opposite edge of the card is tapered to provide a polarization function. Therefore this zero insertion force card seating and locking mechanism may be an improved mechanism for cards. The card may be inserted in the channel or slot with its planars reversed. As a result, the sharp flat corner of edge of card engages the parallel side of the sensor pin, thus preventing the card from being fully inserted in the connector slot. Therefore this ZIF card seating and locking mechanism may be an improved mechanism for cards.

A low-cost ZIF connector system disclosed in IBM Technical Disclosure Bulletin, Vol. 31, No. 4, pp. 55, 56, dated September 1988, describes a method of connecting together PC boards to PC cards and flexible PC cables using a low-cost, ZIF connector. The basic connector can be operated by various methods to apply a contact force after insertion. Options described are mechanical cam-operated or sliding-wedge operated using a solenoid or memory alloy compression springs. In all methods, a contact wiping action occurs when the connector is closed. The flexible cable is continuous; only one component is needed to connect several connectors together. The design allows the flexible cable to be omitted where expedient. The connector will then accept a single card. In this case, the design will provide output pins on the connector. The connector block includes parallel multi-pin contacts accepting a PC card. An unbroken flexible printed circuit tape cable with conducting bands on both sides is sandwiched between the slot formed by the left and right hand clamps of the connecting block passing under a retaining roller. Contacts are arranged on clamps to mate with the conductors on the flexible cable. Coincident conductors on the opposite side of the flexible cable mate with contacts on the inserted PC card.

When the card is fully inserted, the sides of the connector block are clamped inwards by raising the end plate assembly by rotating the cam manually. The clamps are brought together by the action of the pins on the end of the clamps sliding in the diagonal slots. The end plates are raised and lowered by the slotted disc and pin arrangement.

The result of the clamps being pivoted at their base is to cause the flexible cable edge to have a downward component of motion as the clamps close. This drags the clamp surface across the back of the flexible cable which also pulls across the card which has been inserted. The connector may be opened and closed to release or grip the card edge connector. The flexible surface is forced to wipe the card edge connector, this being an important requirement for making a reliable contact. The amount of wiping action is governed by the relative friction coefficients between the clamp and the back of cable and the front of cable and the card.

An alternative to the manual cam arrangement of raising and lowering the end plate array may be used. A sliding wedge actuator is operated by a solenoid or a memory compression spring to overcome a permanent bias tension spring. Heat energy from a resistance is applied to the memory spring only during the period of replugging.

A cam-actuated Zero Insertion Force connector disclosed in IBM Technical Disclosure Bulletin, Vol. 30, No. 5, pp. 289, 290, dated October 1987, discloses a pair of cams judiciously positioned at each end of a side-entry edge-card connector actuated by the card, which in turn actuates the spring contacts of the connector. The improved arrangement includes a pair of cams, the cams being located at the opposite end of a ZIF connector, the details of which are not shown for the sake of clarity. The cams pivot about points and have the configurations shown. A movable element is a driving piece or cam which is coupled to the ZIF springs to operate the springs between their contacting and non-contacting positions. The operation taking place during the insertion of a card in the direction from left to right. At this time the card moves over the flat portion of cam and drive member. When the right side of the card comes in contact with the cam, it causes the cam to rotate clockwise, with the result being that the driving piece moves to the left. In turn, the cam is forced to rotate in a clockwise direction, so that the card is locked in place. Concurrently, the motion of driving piece to the left closes the connector's springs, establishing contact between them and the card contact tabs.

When a card is extracted, the card is pulled to the left, and the left edge of the card engages the cam and rotates it counterclockwise, whereupon the driving piece is moved to the right, and it in turn causes the cam to rotate counter-clockwise, to thereby return to its initial position.

Previous ZIF connectors have also employed handles to actuate them. Since the present arrangement eliminates the requirement for handles, it provides several advantages. Space is no longer required for handle travel, thereby reducing the overall size of the package. Secondly, the space previously occupied by the ZIF handle in the package is now available for air flow which enhances the cooling of the package. Assembly time is reduced by the elimination of the time required to actuate the handles. Card cocking problems occurring because only one handle at a time can be actuated are eliminated. With the present arrangement, top and bottom ZIF connectors would be actuated simultaneously, eliminating card cocking and thus insuring good electrical contact between the ZIF springs and the card tabs.

It is an object of this invention to provide a zero insertion force connector having a horizontally slidable cam system that moves a retention lobe into contact with a positioner that is connected to and positions a component card with contact tabs on it. The positioner includes a lobe opening that provides physical positioning of the component card tabs in relation to the connector contacts positioned in the zero insertion force connector when the retention lobe is mated.

In accordance with these and other objects which will be apparent hereinafter, the instant invention will now be described with particular reference to the accompanying drawings.

SUMMARY OF THE INVENTION

This invention provides a combinable component card, component card positioner and a zero insertion force connector system that provides improved interconnection in an improved combined system useable in larger data processing equipment. The zero insertion force connector system of the invention includes various mating structures. The zero insertion force connector system provides a housing to support the various parts and to surround a card channel that can receive the component card with the component card positioner. The structural elements in the housing are interrelated with all the components of the component card positioner, which may be integrated with the component card. This interconnection provides a more stable combined structure. The component card in this invention includes card contact tabs that are interconnectable and positionable with respect to connector contacts in the housing. The component card positioner provides a means to aid in the orientation and positioning of the component card and also provides a protection tab cover to protect the electrical tabs on the component card. The lower portion of the component card positioner provides guide means to guide the component card into the housing channel and to also provide mating interconnections for final mating with the housing.

The zero insertion force connector system includes a housing with a top entry. The top entry is a card guide channel that passes between a portion of the sides of the housing. The card guide channel provides a polarization acceptance channel with electrical connector contacts. Along the bottom of the card guide channel adjacent the component card positioner is a sliding cam system. The sliding cam system includes a slot along each side of the housing adjacent the bottom of the card guide channel and adjacent the downward position of the card guide channel positioner with its card guide channel opening. The sliding cam system includes a retention lobe matable with the card guide channel lobe opening by back and forth sliding movement of the sliding cam system in the slot along each side of the housing.

The component card includes electrical card contact tabs for use in the improved interconnection of this system and for use with adjacent apparatus.

The component card positioner may be integrated with the component card or attachable with the component card to protect, support and provide mating with the zero insertion force connector system through its card guide channel lobe opening, and protecting card contact tabs through its tab cover structure.

Therefore the zero insertion force connector system provides a new and improved interconnection with the component card and the component card positioner for providing an improved system that: (1) is adaptable for accepting different card heights, (2) minimizes dimensions and tolerances, and (3) is more resistant to failure due to temperature changes, vibrations and shock. Wipe losses resulting from card and package deflections are also minimized.

BEST MODE FOR CARRYING OUT THE INVENTION

Figure 2:
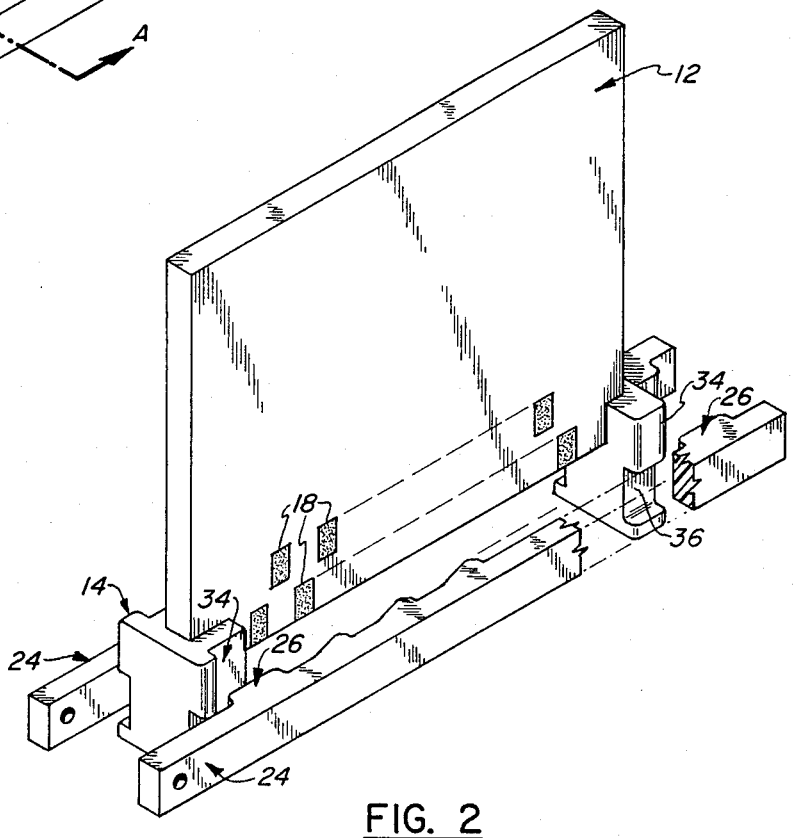
FIG. 2 is a partially cut-away diagrammatic perspective view of FIG. 1 with the component card and its card guide channel positioners inserted in the housing and sliding cam system of the zero insertion force connector system, the tab cover structure 32 being removed for clarity.
Figure 3:
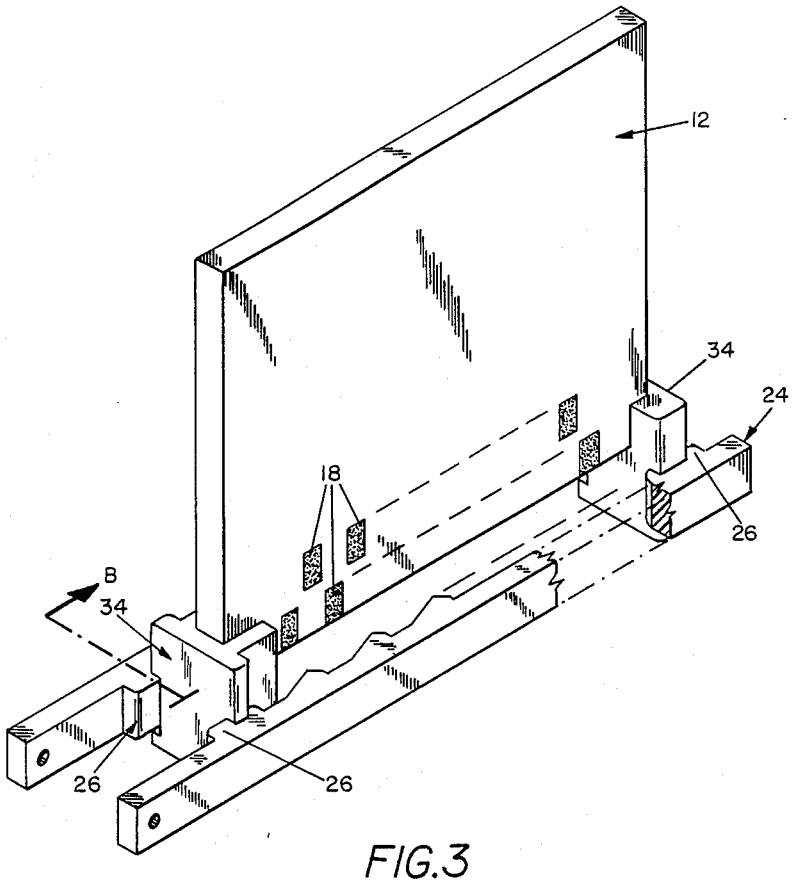
FIG. 3 is similar to FIG. 2 with the sliding cam system of the zero insertion force connector system in a mated position.
Figure 4:
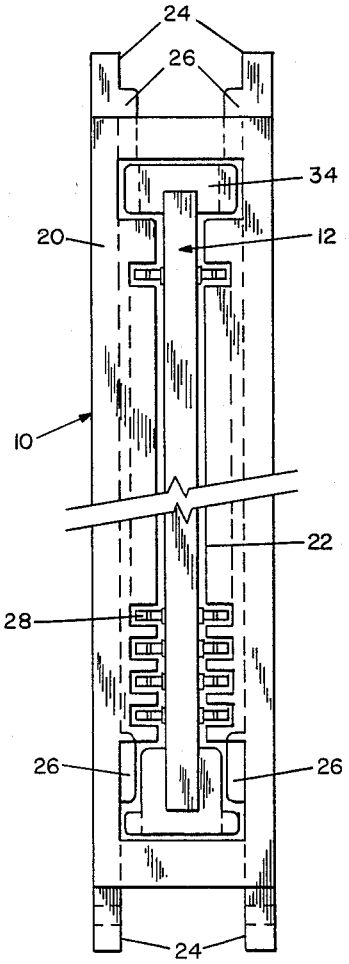
FIG. 4 is a top view of FIG. 1 with the lobe of the sliding cam system in the position as shown in FIG. 2.

In the drawings, there is shown a zero insertion force connector system 10 with a top entry for improved interconnection with a component card 12 with card contact tabs 18 and a component card positioner means 14 for providing an interconnectable structure (as illustrated in FIGS. 2 and 3) that is useable with adjacent data process apparatus. Included in the zero insertion force connector system is a housing 20 with the top entry 16. The housing 20 has a card guide channel 22 having a top being part of the top entry 16. The zero insertion force connector system 10 also includes a sliding cam system 24 with a component card retention lobe 26 for interlocking the component card positioner 14 and the component card 12 in an improved manner. The component card positioner 14 includes a card positioning structure 30 with a tab cover structure 32 and a card guide channel positioner 34 for interaction with the sliding cam system 24 of the zero insertion force connector system 10 to properly retain the component card 12. The component card 12 includes said card contact tabs 18 protected by tab cover structure 32 and related to connector contacts 28 positioned in the housing 20 of the zero insertion force connector system 10. By related is meant that each contact tab 18 is designed for being contacted by a respective connector contact 28 when card 12 is fully positioned within housing 20. As shown, the card retention lobes 26 mate with the lobe mating structure or the lobe positioner (opening) 36 in the guide channel positioner 34 for positioning the component card 12 in an improved physical manner.

It should be noted that the component card 12 shown in FIGS. 1 through 5 is assembled with the component card positioner means 14 shown around the component card and on the lower right and left. Also, the component card positioner means 14 includes the tab cover structure 32 having a precise positional relationship with the card contact tabs 18 in the horizontal and vertical directions. The zero insertion force system 10 has its housing 20 with matching card position acceptance channels in card guide channel 22 which have a similar position/relationship with the component card positioner means 14, card contact tabs 18, and connector contacts 28. Vertical seating of the component card 12 into housing 20 provides card polarization and horizontal alignment between the card contact tabs 18 and connector contacts 28. Actuation of the linear cams in the sliding cam system 24 engages cam lobes or retention lobes 26 and card lobe openings 36 to provide precision alignment vertically between card contact tabs 18 and connector contacts 28. This engagement provides a mechanical constraint between the component card 12 and the housing 20 in the vertical direction to assure card movement does not occur as a result of the wiping action of the connector contacts 28 against the card tabs 18 (see especially FIG. 5).

Two parallel sliding horizontal cams are shown in each Figure. Each sliding horizontal cam has a retention lobe 26 on each end which assumes a locking engagement with the respective positioning detent by movement into the lobe openings 36 as shown in FIG. 3. Secondarily, additional lobes on the sliding horizontal cam 24 engage connector contacts 28, pushing these against the card contact tabs 18 after the male component card is inserted, thereby providing wiping action for better conductive contact.

It should be noted that this invention provides a combinable component card 12 with a separate or integrated component card positioner 14 and a zero insertion force connector system 10 that provides an improved interconnection and an improved combined system for better contacts between the card contact tabs 18 and connector contacts 28 usable as a unit and within larger data processing equipment. As understood, the zero insertion force connector system 10 of the invention includes various mating structures. The zero insertion force connector system 10 provides a housing 20 to support the various parts and to surround a card channel that can receive the component card 12 with the component card positioner 14. The structural elements in the housing 20 are interrelated with all the components or parts of the component card 12 as well as the component card positioner 14. As stated, the component card positioner 14 is connected to or integrated with the component card 12. This interconnection of the zero insertion force connector system 10 with the component card 12 and the component card positioner 14 provides a more stable combined structure. This structure aligns the electrical contact tab means and the connector contacts 28 in the housing 20. The component card 12 in this invention includes card contact tabs 18 that are interconnectable and positionable with respect to connector contacts 28 in the housing 20. The component card positioner 14 provides a card guide channel positioner 34 with mating means or lobe openings 36 to aid in the orientation and positioning of the tabs 18 of the component card 12. The lower portion of the component card positioner 34 provides guide means to guide the component card into the housing channel and to also provide mating interconnections for final mating with the housing.

The zero insertion force connector system 10 provides a new and improved interconnection with the component card 12 and the component card positioner 14 for providing an improved wiping of the component card tabs and orientation with the connector contacts 28. The system is designed in a manner so that it can readily accept different height cards, affords minimal buildup of dimensions and tolerances, and resists contact movement once mated due to temperature changes, vibrations, shock and component card motion.

Figure 5:
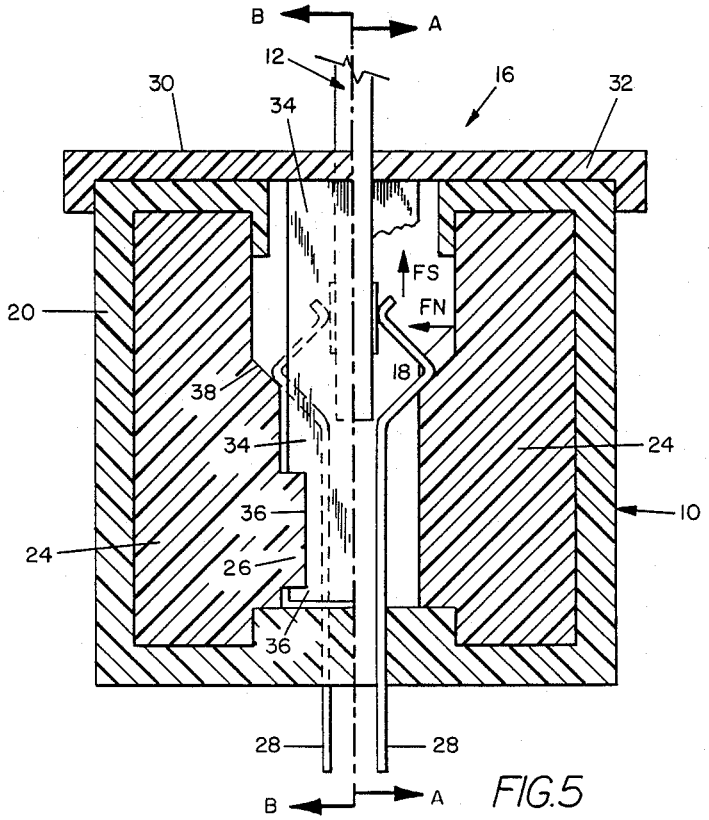
FIG. 5 is a cross section of the housing shown in FIG. 1 with the right side thereof taken along line A and the left side thereof taken along line B with the sliding cam and the card lobe opening in the position shown in FIG. 3.

FIG. 5 presents a front cross section of the connector system 10 showing the housing 20, card positioning structure 30, cam system 24, connector contacts 28, and component card 12. FIG. 5 shows two different cross sections (as described above) with the cross sectional front views of the sliding cam system 24 showing the card retention lobe 26 and the connector contact cam 38. FIG. 5 shows the card positioning structure 30 integral with the tab cover structure 32 and card guide channel positioner 34.

Figure 1:
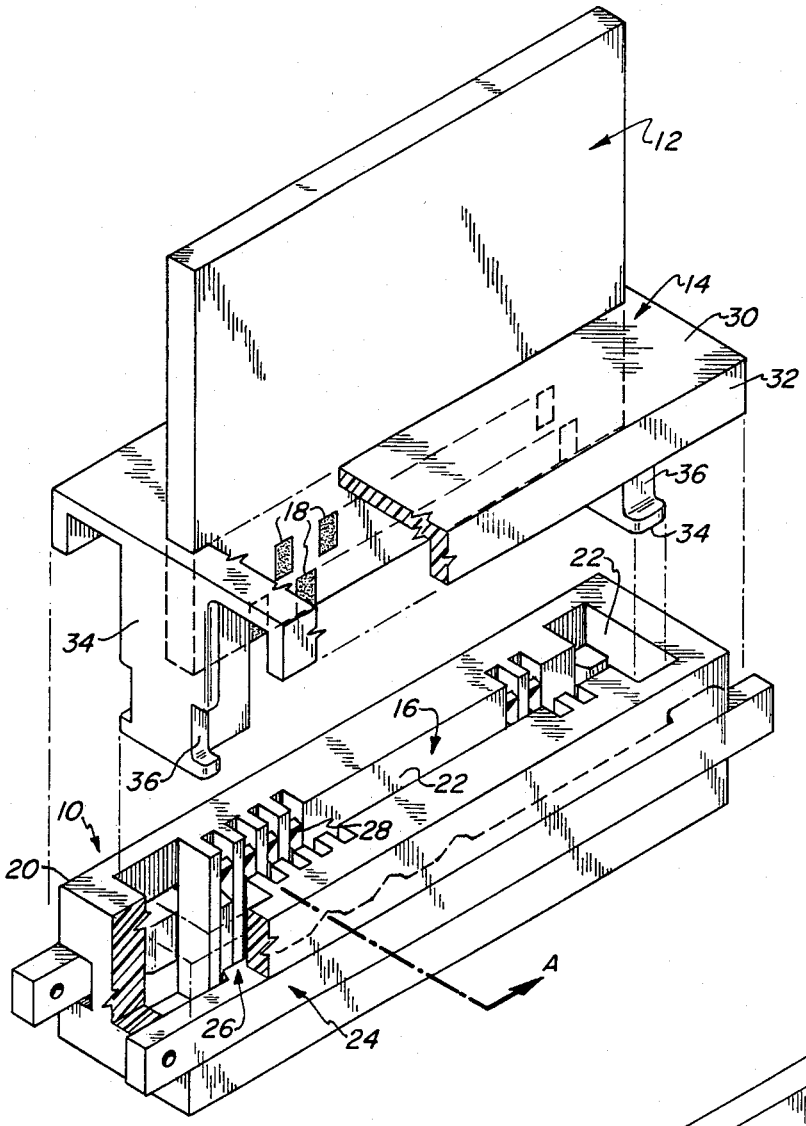
FIG. 1 is a partially cut-away diagrammatic perspective view of the component card and component card positioner that are partially exploded from the zero insertion force connector system with its housing and sliding cam system.

FIGS. 1 and 5 show the card contact tabs 18 and the respective, associated connector contacts 28. To generate good electrical contact in the ZIF connector system 10, the system must generate sufficient contact normal force FN and contact wiping force FS as shown in FIG. 5 between the contacts 28 and contact tabs 18 to break down and remove any non-conductive films, oxides, or debris that may be present on the contact surfaces. For the contact wiping force FS to occur, the component card 12 must be constrained within the connector system 10 during actuation of the two sliding cams 24. This constraining feature is accomplished by actuating the sliding cams 24 which each thereby engages a respective card retention lobe 26 in the card lobe opening 36 of the card guide channel positioner 34 contained on the card positioning structure 30 illustrated in FIG. 5. With the card positioning structure 30 also integral to the component card 12 and its contact tab 18 shown in FIG. 5, the system is locked to prevent movement as the sliding cams 24 are further advanced and the connector contacts 28 are forced onto the surface of the contact tabs 18. The connector contact cam 38 of the sliding cam 28 moves connector contact 28 into contact with contact tab 18 as shown in FIG. 5.

In reference to the construction materials, manufacture and assembly of components, the component card 20 is typically made by laminating alternative layers of copper with a dielectric consisting of glass cloth impregnated with epoxy. The copper layers are circuitized via photo lithography techniques and can be interconnected with plated-thru-holes (as are known in the art). The contact tabs 18 are manufactured as part of the circuitization process and are typically overplated with a nickel layer followed by an overplating of an alloy of gold.

Further, the card positioning structure 30 (which includes the tab cover structure 32, the component card positioner 14, the card guide channel positioner 34 and its lobe positioner 36) may be made by injection molding a plastic resin such as polycarbonate, or by diecasting a suitable metal such as aluminum. The card positioning structure 30 can be attached to its component card 20 by adhesive bonding, insert molding, snap-on latching, or by mechanical fasteners such as screws, rivets, etc.

Further, the connector system 10 consists of a housing 20 which is typically made by injection molding a plastic such as polycarbonate. Assembled within the housing 20 are the described connector contacts 28 and pair of opposed sliding cams 24. The sliding cams are typically made of molded plastic such as polycarbonate. Lubricating agents such as Teflon or other suitable agents may be blended within the plastic molded resin or applied to the surface of the molded sliding cams to reduce friction and wear against the housing 20 and connector contacts 28. The connector contacts are typically made by stamping and forming conductive spring metals such as phosphor bronze or beryllium copper. The stamped metal is then overplated or clad with a thin contact metal such as gold, palladium, or alloys thereof. The connector contacts are typically assembled within the housing 20 by mechanical staking or bonding.

In addition, actuation of the sliding cams 24 within the connector system's housing can be accomplished by a lever (not shown) attached to the ends of each cam with suitable linkage and mechanical advantage to overcome the friction created by mated and moving members (sliding cam 24, housing 20, connector contacts 28, and contact tabs 18) during connector actuation and deactuation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A zero insertion force connector system for connection with a component card and a component card positioner comprising:

said component card including contact tabs movable into said zero insertion force connector system, said zero insertion force connector system including, a housing with a top entry; and a card guide channel in said housing extending inward from said top entry, connector contacts positioned in said housing, said connector contacts movable to contact said contact tabs on said component card in said card guide channel, sliding cam means located and movable within said housing, said sliding cam means including positioning mating means for positioning said component card in said housing and for positioning said contact tabs relative to said connector contacts for electrically conductive contact therebetween, said sliding cam means contacting and actuating said contacts, said component card positioner mounted on said component card and connectable to said housing, said component card positioner including card guide channel positioner means connected to said component card and connectable in said card guide channel in said housing, said card guide channel positioner means for mating with said sliding cam means for proper seating of said component card and proper alignment of said contact tabs with said connector contacts;

said zero insertion force connector system retaining said component card in a constrained manner to thereby resist component card movement and assure proper contact wiping action between said connector contacts and said contact tabs.

2. A zero insertion force connector system as set forth in claim 1, wherein:

said component card and said component card positioner are interconnected as a unit.

3. A zero insertion force connector system as set forth in claim 2, wherein:

said component card positioner includes a top cover means for providing a dust cover and damage cover for said component card to protect against contact dust and contact damage.

4. A zero insertion force connector system as set forth in claim 3, wherein:

said component card positioner interconnects with said housing and said sliding cam means for providing a rigid interconnection when mated to resist contact movement due to shock, vibration, thermal cycling and component card motion.

5. A zero insertion force connector system as set forth in claim 1, wherein said sliding cam means includes:

a structural means movable horizontally in said housing, said structural means of said sliding cam means positionable for movement in a lower portion of said component card insertable vertically into said card guide channel, said component card and said insertion force connector, said component card and said card guide channel positioner means movable into said card guide channel and said positioner means movable into contact with said structural means of said sliding cam means, said sliding cam means including mating means on said structural means for orientating said contact tabs for wiping by said connector contacts.

6. A zero insertion force connector system as set forth in claim 5, wherein:

said mating means includes mating retention lobes positioned on said structural means, said guide card channel positioner means includes means for accepting contact with said mating retention lobes.

* * * * *